United States Patent [19]

Crenshaw

[11] 4,418,451

[45] Dec. 6, 1983

[54] METHODS FOR THE PRODUCTION OF MULTI-LEVEL SURFACE PATTERNED MATERIALS

[75] Inventor: Edward L. Crenshaw, Spartanburg, S.C.

[73] Assignee: Milliken Research Corporation, Spartanburg, S.C.

[21] Appl. No.: 227,723

[22] Filed: Jan. 23, 1981

[51] Int. Cl.[3] ..... D06C 23/04

[52] U.S. Cl. ..... 26/2 R; 28/160; 428/89

[58] Field of Search ..... 26/2 R, 69 A; 26/69 R; 28/160, 163, 248; 428/89

[56] References Cited

U.S. PATENT DOCUMENTS

| | | | |
|---|---|---|---|
| 2,373,194 | 4/1945 | Luttge . | |
| 2,875,504 | 3/1959 | White . | |
| 2,988,800 | 6/1961 | White . | |
| 3,256,581 | 6/1966 | Thal et al. | 26/2 R |
| 3,443,878 | 5/1969 | Weber et al. . | |
| 3,729,784 | 5/1973 | Mazzone et al. | 26/2 R |
| 3,842,468 | 10/1974 | Harrison | 28/248 |
| 3,856,598 | 12/1974 | Gregorian et al. | 28/160 X |
| 4,323,760 | 4/1982 | Greenway et al. | 26/2 R X |

FOREIGN PATENT DOCUMENTS

| | | | |
|---|---|---|---|
| 1951834 | 5/1971 | Fed. Rep. of Germany | 26/2 R |
| 978452 | 12/1964 | United Kingdom . | |
| 1028441 | 5/1966 | United Kingdom . | |
| 1101899 | 1/1968 | United Kingdom . | |
| 1171543 | 11/1969 | United Kingdom . | |
| 1172289 | 11/1969 | United Kingdom . | |

*Primary Examiner*—Robert Mackey

*Attorney, Agent, or Firm*—George M. Fisher; H. William Petry

[57] ABSTRACT

A method of producing surface height patterned materials by application of streams of pressurized, heated fluid into surface areas of a relatively moving material having thermally modifiable surface components. The heated fluid streams are selectively activated and deactivated in accordance with pattern information to strike selected surface areas of the material to thermally shrink and compact the surface areas by a desired amount. Heated fluid stream flow is controlled by use of cooler pressurized fluid which is selectively directed into the heated fluid stream flow to block the same from striking the surface of the moving material. The temperature of selected of the heated fluid streams striking the material is controllably varied by rapidly introducing small amounts of cooler fluid which blend into the heated streams to correspondingly vary the height reduction of the surface of the material.

The method is particularly suited for production of patterned pile fabrics containing thermoplastic pile yarn components, whereby the height of the pile yarns in the areas contacted by the streams may be reduced by varying amounts, depending upon the pattern-controlled introduction of cooler fluid into the heated fluid streams.

Multiple height, surface-patterned products produced by the aforementioned method are also disclosed.

10 Claims, 8 Drawing Figures

METHODS FOR THE PRODUCTION OF MULTI-LEVEL SURFACE PATTERNED MATERIALS

This invention relates to the production of surface-patterned materials, and, more particularly, to a method of producing surface-patterned materials, such as pile fabrics, having multiple surface heights by application of pressurized heated fluid streams to selected surface areas thereof. The invention also includes patterned products produced by such method.

BACKGROUND OF THE INVENTION

It is known to impart visual surface changes to pile fabrics containing thermoplastic pile yarns by directing pressurized heated fluid streams, such as air or steam, into selected areas of the pile surface of the fabric to thermally modify and change the visual appearance of the pile yarns in such areas. U.S. Pat. No. 3,613,186 discloses apparatus for producing pattern effects in pile fabrics by directing heated pressurized air into the fabric from a row of jets mounted in a long heater block which may be moved into two directions over the fabric which also may be moving. Air is supplied to the heater jets through individual air supply lines from an elongate air manifold, and a manually operated valve is provided in each supply line to permit certain of the jets to be cut off, or the air flow thereto to be altered, to change the particular design to be applied to the fabric. Heated air streams striking the pile fabric surface are stated to produce sculptured effects in the thermosplastic surface components thereof, and the pattern is produced by movement of the jets and/or fabric in directions related to each other.

Other apparatus for applying heated pressurized fluid streams to the surface of pile fabrics to alter their surface appearance are disclosed in U.S. Pat. Nos. 2,241,,222; 3,010,179; and 3,585,098. Generally such prior art apparatus provide a continuous flow of the heated fluid streams into the moving fabric during the patterning operation, and the pattern is obtained by relative movement of the fabric and stream applicator manifold during the treating operation.

In hot fluid stream patterning of pile fabrics and other substrate materials having thermally modifiable surface components, highly precise control of the pressure, temperature and direction of the streams striking the substrate material is required to obtain corresponding uniformity and preciseness in the resultant surface pattern formed in the material. If the heated fluid streams are discharged from a row of discharge outlets disposed across a moving pile fabric, unless the temperature and pressure of all streams across the width of the fabric is controllable, variations can occur in the shrinkage and compaction of the pile yarns contacted thereby, resulting in undesirable pattern irregularities in the fabric product.

Difficulties are encountered in maintaining precise control of the pressure and temperature of individual heated fluid streams when their rate of flow is controlled by use of conventional valves located directly in the heated fluid stream supply lines. For example, if the streams are discharged through individual jets having individual manually adjustable valves and a common heater for heating the jets, as in prior U.S. Pat. No. 3,613,186, it can be appreciated that when the rate of air fluid flow through one of the jets is varied by its manual control valve, the temperature of the air stream striking the fabric may increase or decrease because of the change in air flow through the heater. In like manner, if certain jets are completely cut off, the temperature of the heater block will tend to increase in that area, causing an increase in the temperature of the streams from the adjacent jets.

Recently, apparatus has been developed for more precise and uniform control of temperature and pressure of pressurized heated fluid streams to enable more precise and intricate patterning of relatively moving substrate materials, such as textile pile fabrics. Such apparatus comprises an elongate pressurized heated air distribution manifold having a row of heated air discharge channels located in closely spaced relation across the path of the moving substrate material to discharge heated air streams in the material surface. Air is supplied to the manifold through a bank of individual heater units which are controlled to introduce the air into the manifold at a uniform temperature at uniformly spaced locations across its full width. Flow directing baffles provided within the manifold uniformly distribute the incoming air as it flows across the manifold to the discharge channels, and the air is thus discharged therefrom in streams of uniform temperature and pressure.

Flow of the heated air through the discharge channels of the above-described manifold is controlled by the use of pressurized cool air which is delivered by individual cool air supply lines into each channel to block the passage of heated air flow therethrough. Each cool air supply line is provided with an individual control valve, and the cool air control valves are selectively opened or closed in response to signal information from a pattern source, such as a computer program, to block or allow the flow of heated air streams to strike the woving fabric in selected areas and impart a pattern thereto. Depending upon the pattern control information, the surface pattern applied to the fabric can be selectively varied in both lengthwise and widthwise direction of the fabric movement.

In use of such improved apparatus to pattern pile fabrics containing thermoplastic pile yarns, the pressurized air streams which strike selected surface areas of the moving fabric uniformly longitudinally shrink and compact the pile yarns into the fabric in such areas to form precise grooves of uniform depth, with the length of the grooves and their spacing in the fabric being controlled by the pattern control information sent to the cool air valves to produce a precise surface pattern characterized by untreated high pile areas and uniformly thermally treated low pile height areas.

BRIEF OBJECTS OF THE INVENTION

It is an object of the present invention to provide a method of patterning a substrate material containing thermally modifiable surface components by application of pressurized heated fluid streams to selected surface areas of the material to achieve multiple surface height pattern effects therein.

It is another object to provide a method of heated fluid stream patterning of pile fabrics in accordance with pattern control information, wherein the heated fluid streams striking the fabric are controlled in temperature to provide fabric patterns characterized by areas of high, low and intermediate pile heights.

It is a further object to provide novel multiple height surface-patterned materials, such as pile fabrics, by heated stream thermal modification of the surface components thereof.

BRIEF DESCRIPTION OF THE INVENTION

The present invention is directed to a method of precisely patterning thermally modifiable substrate material surfaces by use of the above described improved heated fluid stream patterning apparatus, wherein increased patterning capabilities are obtained. More specifically, the method of the present invention provides for multiple height surface patterning of substrates, particularly pile fabrics containing thermoplastic yarn components, by controlling the temperature of the pressurized fluid striking selected surface areas thereof, such that high, low, and intermediate surface height patterns may be produced in the substrate, while minimizing pattern irregularities resulting from uncontrolled pressure and temperature variations in the streams.

It has been found that the temperature of fluid in a particular stream striking a selected surface area of a pile fabric during its relative movement may be varied to provide greater or less thermal shrinkage and compaction of the pile yarns by introducing controlled amounts of a cooler fluid into the heated air stream such that controlled amounts of cooler fluid are blended with the heated fluid to lower its temperature by a desired amount. Depending upon the temperature of the pressurized fluid striking a selected pile surface area, the pile yarns therein are correspondingly shrunk and compacted to varying degrees, thereby producing patterned pile fabrics characterized by high, low, and intermediate heights of pile in the fabric surface. Such effect can be achieved both in lengthwise and widthwise direction of the fabric and provides broader patterning capabilities with a high degree of precision and accuracy than is believed to have been attainable heretofore.

BRIEF DESCRIPTION OF THE FIGURES OF THE DRAWINGS

The above as well as other objects of the present invention will become more apparent, and the invention will be better understood, from the following detailed description thereof, when taken together with the accompanying drawings, in which.

DETAILED DESCRIPTION OF PREFERRED EMBODIMENTS

Figure 1:
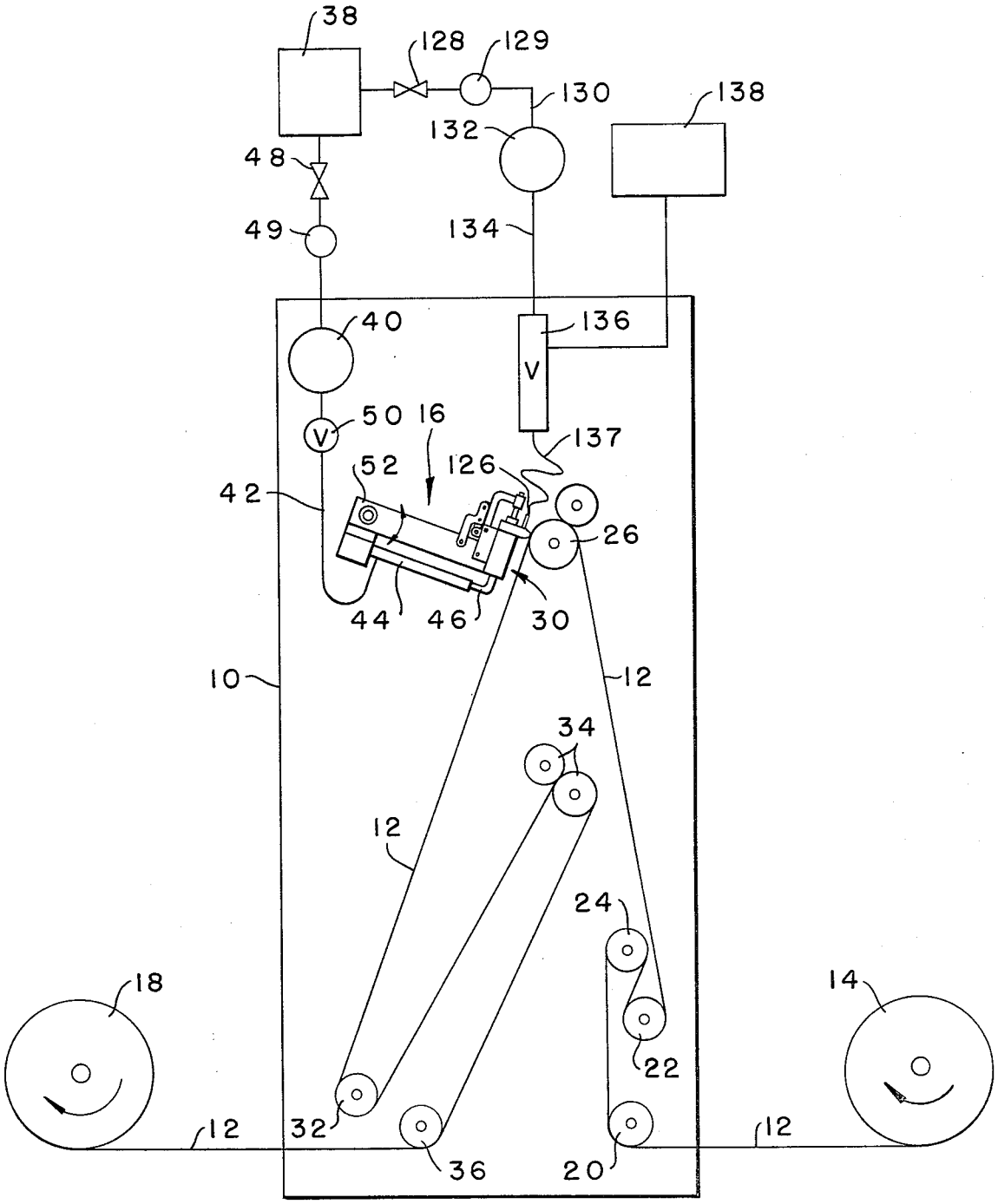
FIG. 1 is a schematic side elevation view of apparatus for pressurized heated fluid stream treatment of a moving substrate material which may be employed to impart a desired surface pattern thereto in accordance with the method of the present invention.

Referring more specifically to the drawings, FIG. 1 shows, diagrammatically, an overall side elevation view of apparatus for pressurized heated fluid stream patterning of a moving substrate material in accordance with the method of the present invention. The apparatus includes a main support frame with end frame support members, one of which 10 is illustrated in FIG. 1. Mounted for rotation to the end members of the frame are a plurality of guide rolls which direct an indefinite length textile pile fabric 12 containing thermoplastic pile yarns from a fabric supply roll 14, past a pressurized heated fluid treating unit, generally indicated at 16. After treatment, the fabric is collected in continous manner on a take-up roll 18. As shown, the pile fabric 12 from supply roll 14 passes over an idler roll 20 and is fed by a pair of driven rolls 22, 24 to a main driven fabric support roll 26 to pass the pile surface of the fabric closely adjacent the heated fluid discharge outlets of a fluid distributing manifold assembly 30 disposed across the path of fabric movement. The treated fabric 12 thereafter passes over driven guide rolls 32, 34 and an idler roll 36 to the take up roll 18 for collection.

As schematically illustrated in FIG. 1, the fluid treating unit 16 includes a source of compressed fluid, such as an air compressor 38, which supplies pressurized air to an elongate air header pipe 40. Header pipe 40 communicates by a series of air lines 42 spaced uniformly along its length with a bank of individual electrical heaters indicated generally at 44. The heaters 44 are arranged in parallel along the length of manifold assembly 30 and supply heated pressurized air thereto through short, individual heated air lines, indicated at 46, which communicate with assembly 30 uniformly along its full length. Air supply to the fluid distributing manifold assembly 30 is controlled by a master control valve 48, pressure regulator valve 49, and individual precision control valves, such as needle valves 50, located in each heater air supply line 42. The heaters are controlled in suitable manner, as by temperature sensing means located in the outlet lines 46 of each heater, with regulation of air flow and electrical power to each of the heaters to maintain the heated fluid at a uniform temperature and pressure as it passes into the manifold assembly along its full length. Typically, for patterning most textile pile fabrics containing thermoplastic pile yarns, the heaters heat the air entering the manifold assembly to a uniform temperature of between about 700° F.–750° F.

Manifold assembly 30 is disposed across the full width of the path of movement of fabric 12 and closely adjacent the pile surface to be treated. Although the length of the manifold assembly may vary, typically in the treatment of textile fabric materials, the length of the manifold assembly may be 76 inches or more to accommodate fabrics of up to about 72 inches in width.

Figure 6:
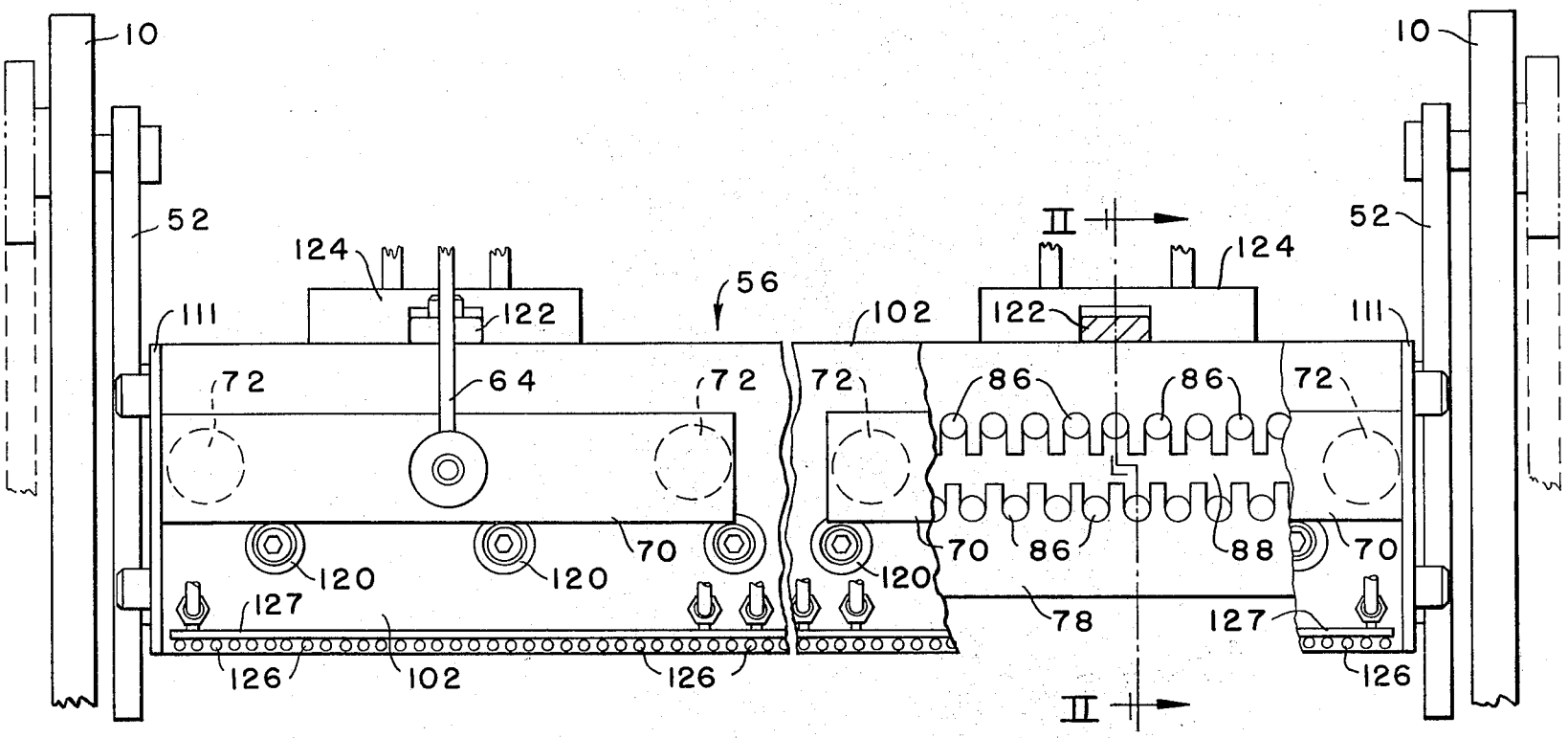
FIG. 6 is a plan view of end portions of the manifold assembly of FIG. 2, with portions thereof broken away.

As illustrated in FIGS. 1 and 6, the elongate manifold assembly 30 and the bank of heaters 44 are supported at their ends on the end frame support members 10 of the main support frame by support arms 52 which are pivotally attached to end members 10 to permit movement of the assembly 30 and heaters 44 away from the surface of the fabric 12 and fabric supporting roller 26 during periods when the movement of the fabric through the treating apparatus may be stopped.

Figure 2:
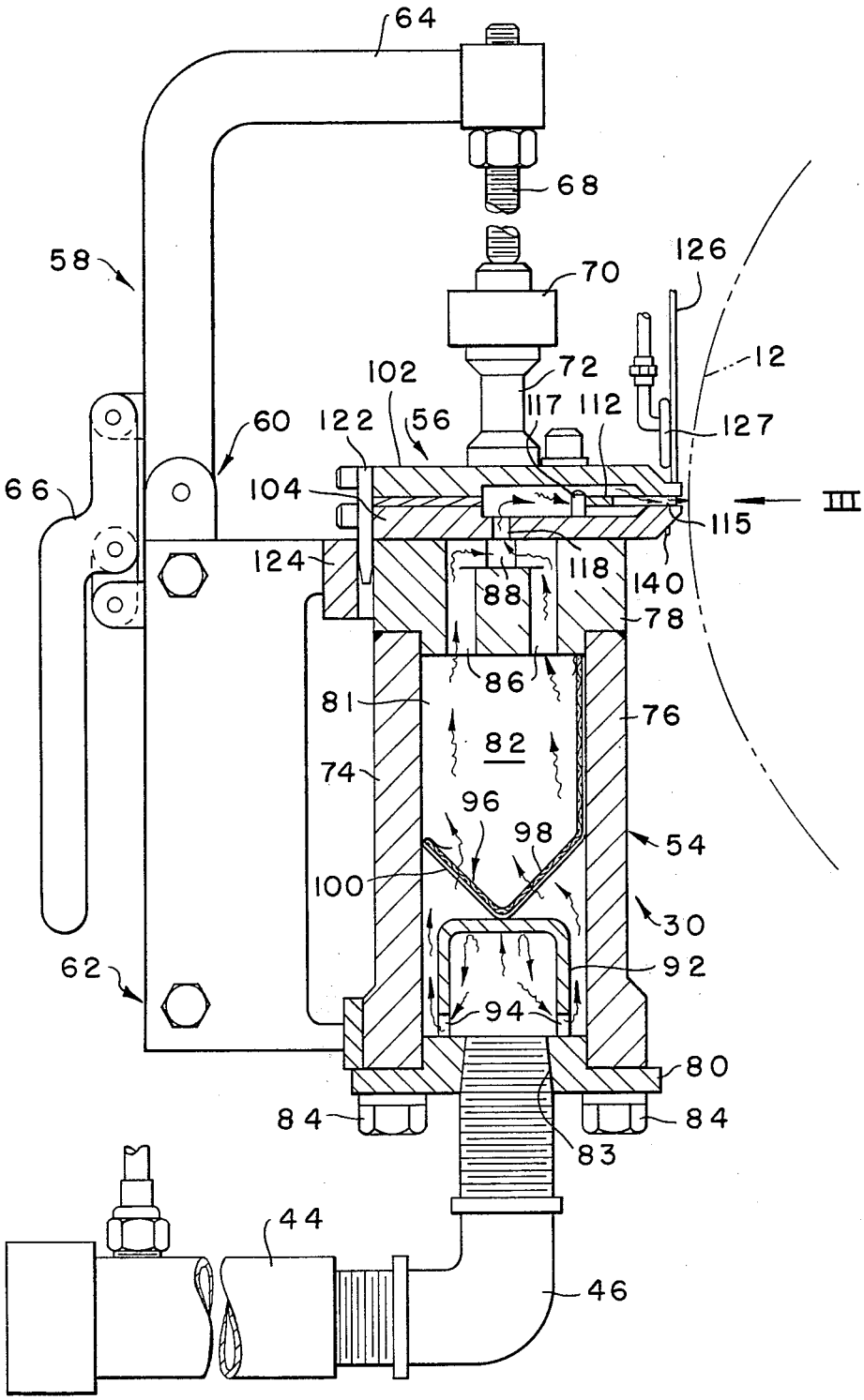
FIG. 2 is an enlarged partial sectional elevation view of the heated fluid distributing manifold assembly of the apparatus of FIG. 1, taken along a section line of the manifold assembly indicated by the line II—II in FIG. 6.

Details of the heated fluid-distributing manifold assembly 30 may be best described by reference to FIGS. 2–6 of the drawings. As seen in FIG. 2, which is a partial sectional elevation view through the assembly, taken along line II—II of FIG. 6, the manifold assembly 30 comprises a first large elongate manifold housing 54 and a second smaller elongate manifold housing 56 secured in fluid tight relationship therewith by a clamping means generally indicated at 58. The manifold housings 54, 56 extend across the full width of the fabric 12 adjacent its path of movement. Clamping means 58 comprises a plurality of manually-operated clamps 60 spaced along the length of the housings. Each clamp includes a first portion 62 fixedly attached, as by welding, to the first manifold housing 54, and a second movable portion 64 pivotally attached to fixed portion 62 by a manually operated handle and linkage mechanism 66. Second portion 64 of clamp 60 includes an adjustable threaded bolt and nut assembly 68 with elongate presser bars 70 which apply pressure to manifold housing 56 through a plurality of spacer blocks 72 which are attached to the surface of housing 56 at spaced locations along its length (FIG. 6).

As best seen in FIG. 2, first elongate manifold housing 54 is of generally rectangular cross-sectional shape, and includes a pair of spaced plates forming side walls 74, 76 which extend across the full width of the path of fabric movement, and elongate top and bottom wall plates 78, 80 which define an elongate fluid-receiving compartment 81, the ends of which are sealed by end wall plates 82 suitably bolted thereto. Communicating with bottom wall plate 80 through fluid inlet openings (one of which, 83, is shown in FIG. 2), spaced uniformly therealong are the air supply lines 46 from each of the electrical heaters 44. The side walls 74, 76 of the housing are connected to top wall plate 78 in suitable manner, as by welding, and the bottom wall plate 80 is removably attached to side walls 74, 76 by bolts 84 to permit access to the housing compartment 81. The plates and walls of the housing 54 are formed of suitable high strength material, such as stainless steel, or the like.

Figure 4:
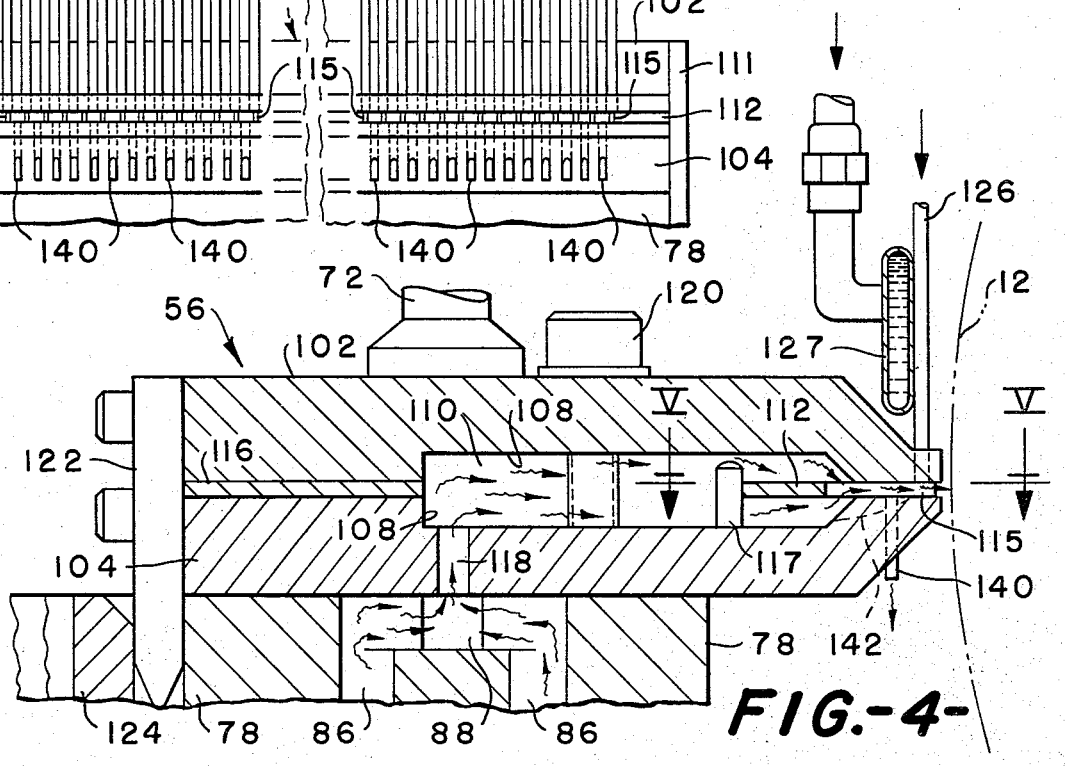
FIG. 4 is an enlarged broken away sectional view of the fluid stream distributing manifold housing of the manifold assembly illustrated in FIG. 2.
Figure 5:
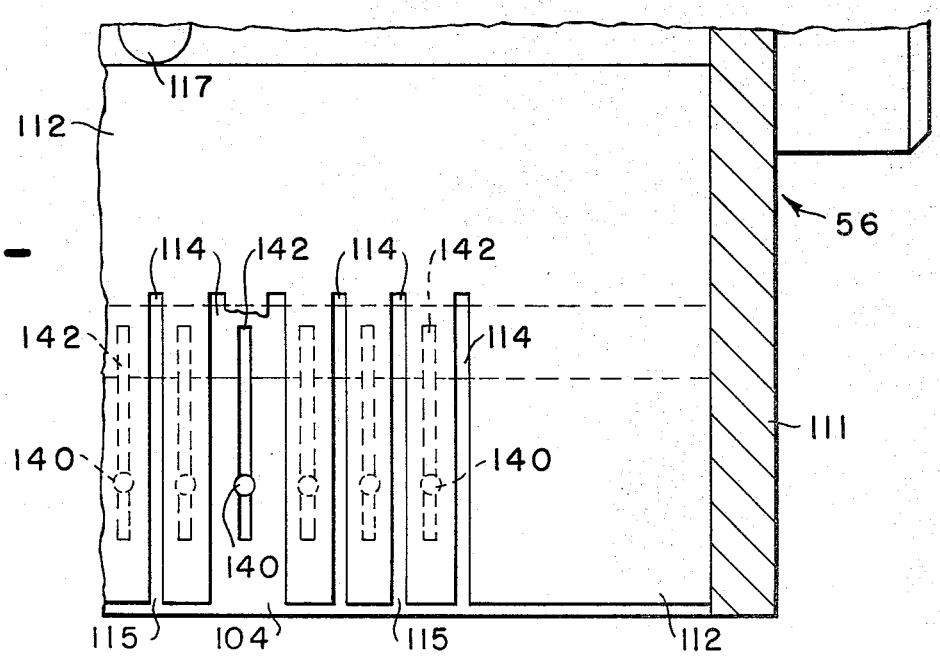
FIG. 5 is an enlarged broken away sectional view of an end portion of the fluid stream distributing manifold housing looking in the direction of arrows V—V in FIG. 4.

As best seen in FIGS. 2, 4 and 6, upper wall plate 78 of manifold housing 54 is of relatively thick construction and is provided with a plurality of air flow passageways 86 which are disposed in uniformly spaced relation along the plate in two rows to communicate the housing compartment 81 with a central elongate channel 88 in the outer face of plate 78 which extends between the passageways along the length of the plate. As seen in FIG. 6, the passageways in one row are located in staggered, spaced relation to the passageways in the other row to provide for uniform distribution of pressurized air into the central channel 88 while minimizing strength loss of the elongate plate 78 in the overall manifold assembly.

As seen in FIG. 2, located in manifold housing 54 and suitably attached to the bottom wall plate 80 of the housing, as by threaded bolts (not shown), is an elongate channel-shaped baffle plate 92 which extends along the length of the housing compartment 81 in overlying relation to wall plate 80 and the spaced air inlet openings 83 to define a fluid-receiving chamber in the compartment having side openings or slots 94 adjacent wall plate 80 to direct the incoming heated air from the bank of heaters in a generallfy reversing path of flow through compartment 81. Disposed above channel-shaped baffle plate 92 in housing compartment 81 between the air inlet openings and air outlet passgeways 86 is an elongate filter member 96 which consists of a perforated generally J-shaped plate 98 with filter screen 100 disposed thereabout. Filter member 96 extends the length of the first manifold housing compartment 81 and serves to filter foreign particles from the heated pressurized air during its passage therethrough. Access to the housing compartment by way of removable bottom wall plate 80 permits periodic cleaning and/or replacement of the filter member, and the filter member is maintained in position in the compartment by frictional engagement with the side walls 74, 76 to permit its quick removal from and replacement in the housing compartment.

Figure 3:
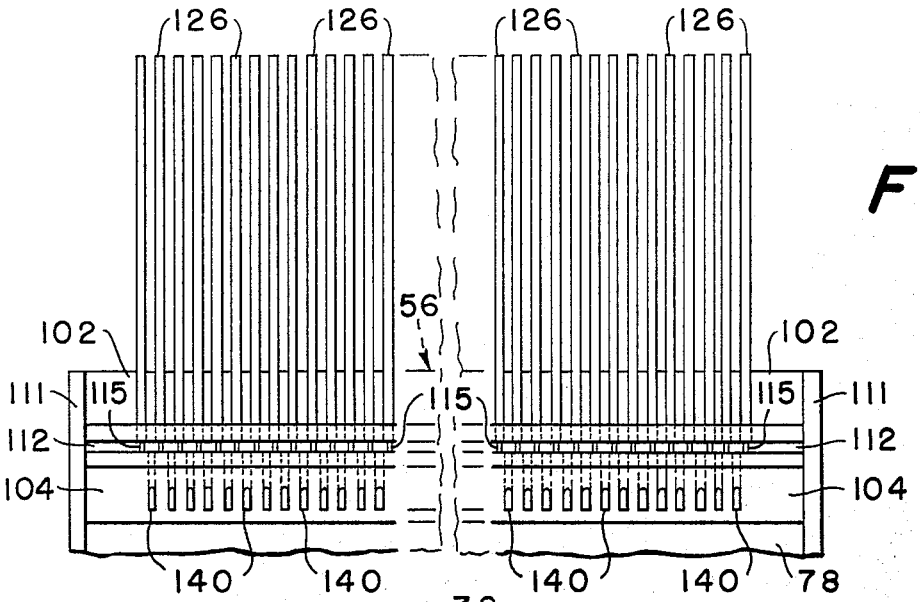
FIG. 3 is a front elevation view of end portions of the fluid distributing manifold assembly of FIG. 1 looking in the direction of arrow III in FIG. 2.

As seen in FIGS. 2 and 4, the smaller fluid stream distributing manifold housing 56 comprises first and second opposed elongate wall members 102, 104, each of which has an elongate recess 108 therein. Wall members 102, 104 are disposed in spaced, coextensive parallel relation with their recesses 108 in facing relation to form upper and lower wall portions of a fluid-receiving compartment 110 of the second manifold housing 56. Ends of the second housing compartment 110 are closed by end plates 111 (FIG. 3). The opposed wall members 102, 104 are maintained in spaced relation by an elongate front shim plate 112 which has a plurality of parallel, elongate notches 114 (FIG. 5) in one side edge thereof, and a rear elongate shim plate 116 disposed between the opposed faces of the wall members in fluid tight engagement therewith. As seen in FIGS. 2–4, the notched edge of shim plate 112 is disposed between the first and second wall members along the front elongate edge portions thereof to form with wall members 102, 104, a plurality of parallel heated air discharge outlet channels 115 which direct heated pressurized air from the second manifold compartment 110 in narrow, discrete streams at a substantially right angle into the surface of the moving fabric substrate material 12. Dowel pins 117 (FIGS. 2 and 4) spaced along housing compartment 110 facilitate alignment of shim plate 112 between wall members 102, 104. Typically, in treatment of pile fabrics containing thermoplastic pile yarn or fiber components, the discharge channels 115 of manifold 56 may be 0.012 inch wide and uniformly spaced on 0.1 inch centers, with 756 discharge channels being located in a row along a 76 inch long manifold assembly. For precise control of the heated air streams striking the fabric, the manifold stream discharge outlets are preferably maintained between about 0.020 to 0.030 inch from the fabric surface being treated.

Lower wall member 104 of the second manifold housing 56 is provided with a plurality of spaced air inlet openings 118 (FIGS. 2 and 4) which communicate with the elongate channel 88 of the first manifold housing 54 along its length to receive pressurized heated air from the first manifold housing into the second manifold housing 56 compartment 110. Wall members 102, 104 of the second manifold housing are connected at spaced locations by a plurality of threaded bolts 120 and the second manifold housing is maintained in fluid tight relation with its shim members and with the elongate channel 88 of the first manifold housing by the adjustable clamps 60. Guide means, comprising a plurality of short guide bars 122 attached to the second manifold housing 56 and received in guide bar openings of brackets 124 attached to the first manifold housing 54, ensure proper alignment of the first and second manifold housings during their attachment by the quick-release clamps.

Each of the heated air discharge outlet channels 115 of the second manifold housing 56 which direct streams of air into the surface of fabric 12 is provided with an air tube 126 (FIGS. 2 and 3) which communicates at a right angle to the discharge axis of the channel to introduce pressurized cool air into the channel in accordance with pattern control information, as will be explained. Air passing through the air tubes 126 may be cooled by a water jacket 127 (FIGS. 2 and 4) which is provided with cooling water from a suitable source, not shown. As seen in FIG. 1, pressurized unheated air is supplied from compressor 38 through a master control valve 128, pressure regulator valve 129, and air line 130 to cool air header pipe 132. Header pipe 132 is connected by a plurality of air supply lines 134 to an array of solenoid-operated, off-on control valves, v, located in a control valve box 136, with a control valve provided for each of the cool air tubes 126 and connected thereto by an individual cool air supply line 137 to control flow of cool air therethrough. These individual control valves are electrically operated to open or close for desired periods of time in response to electrical signals from a pattern control device, illustrated at 138, to selectively introduce pressurized cool air into the individual hot air discharge channels 115 during movement of the fabric.

As seen in FIGS. 2–4, located in the lower wall member 104 of manifold housing 56 between each of the pressurized heated air discharge outlet channels 115 is an air outlet tube 140. Each outlet tube 140 is in continuous communication with the heated air compartment 110 of housing 56 by a passageway 142 to continously bleed-off a portion of heated pressurized air from the housing compartment 110 and direct the same away from the surface of the moving fabric 12 (FIG. 4). The bleed-off of hot air heats the wall portions of the manifold housing 56 and the shim plate 112 to counteract cooling of the same by the pressurized cool air introduced into the channels for blocking the heated air streams.

Figure 7:
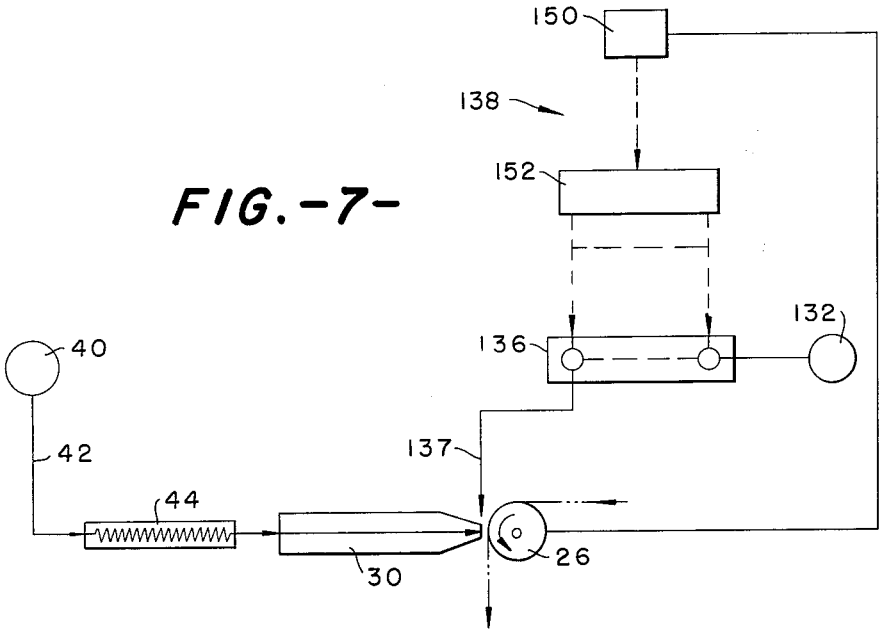
FIG. 7 is a diagrammatic representation of the patterning control components for activating and deactivating the flow of the pressurized heated fluid streams from the manifold assembly of FIGS. 1–6.

A preferred form of pattern control mechanism 138 for opening and closing the cool air control valves to block the flow of selected heated pressurized air streams onto the fabric, or to blend cool air with the heated air for multiple height patterning in accordance with the present invention, is illustrated diagrammatically in FIG. 7 of the drawings. As seen, operatively attached to the rotating support shaft of the driven fabric support roll 26 is a transducer 50, such as a Litton Model 70 Optical Rotary Pulse Generator. Transducer 150 translates rotary motion of the fabric roll 26, and thus linear movement of the pile fabric 12 past the hot air discharge manifold, into a series of electrical pulses which are fed to a pattern storage and control unit 152. Unit 152 may typically be a conventional EPROM unit (Eraseable, Programmable, Read-Only Memory), such as an Intel Model P-2708 EPROM, into which pattern information in the form of binary logic is stored. Each pulse from the transducer 150 is translated into electrical pattern signals by the EPROM which are sent to selected of the cold air valves in valve box 136, to open or close the same and correspondingly control the flow of cold pressurized air via line 137 into the hot air discharge channels of the manifold assembly 30. Typically, the transducer 150 may produce forty signal pulses per inch of fabric movement, such that any of the valves controlling the pressurized cool air may be opened or closed as many as 40 times per linear inch of fabric surface passing the hot air stream manifold assembly 30. The pattern control circuitry may include time delay means to allow cool air to flow for fractional parts of a transducer pulse cycle, i.e., for time periods equivalent to less than 0.025 linear inches of fabric travel.

In use of the above described apparatus to pattern a pile fabric containing thermoplastic yarn components to produce a high and uniformly low surface pattern effect therein, the temperature and pressure of the heated air in the manifold assembly is set at a desired level, depending upon the thermal characteristics of the fabric to be treated, the speed of the fabric surface past the hot air discharge manifold, and the maximum depth of the grooves, i.e., shrinkage and compaction of the pile yarns, desired. Typically, in the treatment of polyester pile fabrics at a fabric speed of movement of between six to eight yards per minute, the temperature of the heated air in the manifold assembly may be between 700°–750° F., and the pressure between $1\frac{1}{2}$ to 4 psig.

During fabric movement, pattern information from the EPROM opens selected of the cold air valves at predetermined intervals established by fabric movement (signals from transducer 150) to block the flow of selected of the heated air streams and to thereby produce no effect in the pile surface height, or closes the valves to allow selected of the heated air streams to strike the fabric to longitudinally shrink and compact the pile yarns therein, thus forming narrow grooves of precise width and uniform depth. Because the temperature and pressure of the heated streams are maintained substantially constant across the width of the manifold, all of the grooves formed by full flow of heated air from the manifold into the fabric surface will be of uniform depth.

In accordance with the present invention, it has been found that if selected of the cold air control valves are rapidly opened and closed during fabric movement past the hot air distributing manifold 30, the small amounts of cold air introduced into the hot air streams do not block the passage of the hot air stream, but blend with the hot air leaving the manifold discharge channels to reduce the temperature of the stream by a controllable amount, dependent upon the amount of cold air which is blended into the hot air stream. Thus, it can be seen that the temperature of each of the hot air streams striking the fabric may be varied in a controlled manner to cause corresponding controlled variation in the amount of pile shrinkage, i.e., height reduction, in the area of the fabric contacted by the streams to produce a surface effect having high, low and various intermediate levels of pile therein.

The following specific example illustrates how the method of the present invention may be carried out with the apparatus hereinabove described. A continuous length 100% polyester knit pile fabric having a fabric thickness of 0.090 inches is passed through the fluid-stream treating apparatus of FIG. 1 at a linear speed of 8 yards per minute. The temperature of the heated air in the hot air manifold 30 is maintained at 700° F. and the discharge outlets of the manifold are set at a distance of 0.030 inches from the pile surface of the fabric. The heated air pressure in the manifold is $3\frac{1}{2}$ psig and the cooler air pressure in the cold air header pipe 132 is maintained at 20 psig. The transducer unit 150 transmits 40 signal pulses per inch of fabric travel past manifold 30 to the EPROM unit 152, and the EPROM unit is provided with a suitable pattern program to translate the pulses into electrical signals to open and close selected of the cold air valves in accordance with the desired pattern to be applied to the fabric.

Figure 8:
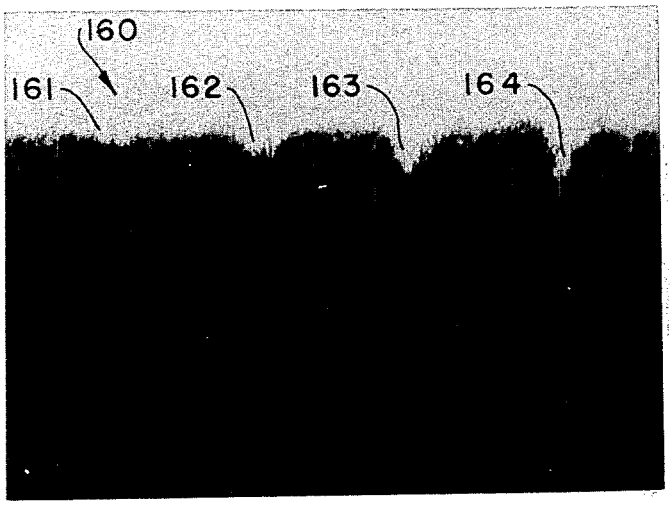
FIG. 8 is a cross-sectional representation of pile fabric treated in accordance with the method of the present invention, and illustrating the multiple height patterning of the yarn components of the same.

FIG. 8 schematically illustrates, in vertical cross section, a widthwise portion of the polyester pile fabric 160 treated under the above conditions. As illustrated, four narrow grooves 161–164 have been formed in the pile surface in the direction of fabric movement past the hot air discharge manifold, with the pile yarns in the grooves being longitudinally shrunk and compacted by varying amounts. Portions of the pile fabric surface between the grooves have not been treated by contact with the hot air streams, and thus retain the normal pile height level of the fabric before treatment. In such areas, the cold air streams are continuously discharged into the hot air discharge channels of the manifold 30 to block the passage of heated air streams into the surface of the fabric.

The left hand groove 161, containing pile yarns of slightly reduced pile height, is formed by opening the cool air valve associated with the hot air discharge channel forming the groove in short pulses of approximately 10 milliseconds, separated by intervals of 5 milliseconds, to introduce incremental amounts of cool air into the heated air stream. Groove 162 is formed by introducing 5 millisecond pulses of cool air into the heated air discharge channel forming the groove separated by intervals of 5 milliseconds, while groove 163 is formed by introducing 5 millisecond pulses of cool air separated by intervals of 10 millisecond duration. The right hand most groove 164 is formed by maintaining the cool air control valve associated therewith closed during movement of the fabric, thereby permitting the full effect of the heated air stream to strike the fabric surface.

Thus, it can be seen that by precise control of the introduction of cool air into the heated air discharge channels of the manifold assembly, a pile surface pattern effect characterized by high, low and intermediate pile height areas is produced, with temperature regulation of the heated air streams by the cool air producing the desired effect in the fabric surface.

Although the apparatus for practicing the method of the present invention has been described as including a hot air discharge manifold 30 with notched shim plate 112 forming a plurality of separate heated air discharge channels located in spaced relation across the moving substrate material, a manifold may be constructed without a notched shim plate to provide an elongate continuous heated air discharge slot, with the cold air supply tubes 126 communicating with the continuous slot at spaced locations along the length of the manifold. In such an arrangement, the discrete stream or streams of heated air are formed by blocking selected portions of the elongate discharge slot with cold air, and multiple height patterning is accomplished by rapidly introducing small controlled amounts of cold air into the discharge stream or streams at selected locations along the slot to vary the temperature of the air striking the fabric.

I claim:

1. In a method of patterning a substrate material containing thermally modifiable surface components by directing streams of heated pressurized fluid into the surface of a relatively moving substrate material to thermally modify and reduce the height of surface areas contacted by the streams while starting and stopping the flow of selected of the streams in accordance with pattern control information; the improvement therein comprising the step of controllably varying the temperature of selected of the heated fluid streams striking selected of said surface areas during relative movement of the substrate material by introducing a controlled amount of cooler fluid into the flow of the heated fluid stream striking each of said selected surface areas to correspondingly vary the height reduction of said selected surface areas and produce a surface pattern characterized by surface areas of high, low and intermediate height while maintaining the length of each of said selected streams.

2. A method as defined in claim 1 wherein the amount of said cooler fluid introduced into a heated fluid stream is controllably varied by rapidly introducing separate amounts of cooler fluid into the heated fluid stream for predetermined times and at predetermined intervals.

3. A method as defined in claim 2 wherein the plurality of streams are directed into the surface of the substrate material at a generally right angle thereto and at spaced locations across the path of relative movement of the substrate.

4. A method as defined in claim 2 wherein the flow of said amounts of cool air into a selected heated fluid stream striking the substrate in a selected area is rapidly started and stopped in accordance with pattern information to correspondingly vary the resultant temperature of the selected stream striking the surface area and cause variation in the reduction in height of the surface area.

5. A method as defined in claim 4 wherein the streams are directed into the surface of the substrate from discharge channels spaced along the length of an elongate fluid discharge manifold, and wherein the pressurized heated fluid is maintained at a substantially uniform temperature and pressure in the manifold along its length.

6. A method as defined in claim 5 wherein the flow of the streams from the manifold onto the surface is started and stopped by directing pressurized cooler fluid across the heated stream discharge channels to block heated fluid stream flow into the substrate material surface.

7. In a method of patterning the pile surface of a relatively moving pile fabric containing thermally modifiable pile yarn components by selective application of streams of pressurized heated fluid into pile surface areas of the fabric in accordance with pattern control information to reduce the pile height in said surface areas, the improvement therewith comprising the steps of controllably varying the temperature of selected of the fluid streams striking selected of said pile surface areas during relative movement of the fabric by rapidly introducing a controlled amount of cooler fluid into the flow of each of said selected fluid streams to controllably vary the fluid stream temperatures during relative movement of the surface area thereby to correspondingly vary the degree of reduction of the pile height in said surface portions and produce a surface pattern in the pile fabric characterized by high, low, and intermediate levels of pile height while maintaining the length of each of said selected streams.

8. A method as defined in claim 7 wherein said fabric is relatively moved by positively moving the fabric in a longitudinal path, said streams are selectively applied to surface portions of the fabric from elongate fluid stream applicator means extending across the path of the fabric to discharge the streams into the fabric surface from selected locations spaced across the fabric path, and wherein the amount of reduction in pile height in said pile surface areas is controlled by varying the frequency and duration of rapid introduction of the cooler fluid into each selected heated fluid stream striking the fabric.

9. A method as defined in claim 8 wherein the frequency and duration of introduction of cooler fluid into each selected stream is varied by initiating control signals in response to movement of selected increments of lengths of fabric past said applicator means, and transmitting pattern information to start and stop flow of cooler fluid into selected of said streams in sequence with said initiated signals.

10. A method as defined in claim 9 wherein flow of said cooler fluid is controlled by valve means, and wherein said pattern information is transmitted to open and close selected of said valve means in sequence with said control signals.

* * * * *

UNITED STATES PATENT AND TRADEMARK OFFICE

CERTIFICATE OF CORRECTION

PATENT NO. : 4,418,451

DATED : December 6, 1983

INVENTOR(S) : Edward L. Crenshaw

It is certified that error appears in the above-identified patent and that said Letters Patent is hereby corrected as shown below:

Column 1, line 24, "into" should be "in";

Column 1, line 35, "related" should be "relative";

Column 2, line 14, "distribution" should be "distributing";

Column 2, line 37, "woving" should be "moving";

Column 4, line 17, "to" should be "on";

Column 7, line 52, "50" should be "150".

Signed and Sealed this

*Tenth* Day of *April 1984*

[SEAL]

*Attest:*

GERALD J. MOSSINGHOFF

*Attesting Officer*

*Commissioner of Patents and Trademarks*